US005967228A

United States Patent [19]

Bergman et al.

[11] Patent Number: 5,967,228

[45] Date of Patent: Oct. 19, 1999

[54] HEAT EXCHANGER HAVING MICROCHANNEL TUBING AND SPINE FIN HEAT TRANSFER SURFACE

[75] Inventors: Mark O. Bergman; Richard E. Cawley, both of Tyler; Stephen S. Hancock, Flint, all of Tex.

[73] Assignee: American Standard Inc., Piscataway, N.J.

[21] Appl. No.: 08/870,517

[22] Filed: Jun. 5, 1997

[51] Int. Cl.[6] ..... F28F 1/36

[52] U.S. Cl. ..... 165/184; 165/177

[58] Field of Search ..... 165/177, 184

[56] References Cited

U.S. PATENT DOCUMENTS

| | | | |
|---|---|---|---|
| 1,744,074 | 1/1930 | Gortner | 165/184 |
| 2,022,173 | 11/1935 | Alexander | 257/230 |
| 2,870,999 | 1/1959 | Söderström | 165/184 |
| 3,202,212 | 8/1965 | Kritzer | 165/179 |
| 3,229,722 | 1/1966 | Kritzer | 138/39 |
| 3,455,379 | 7/1969 | Habdas | 165/184 |
| 3,603,384 | 9/1971 | Huggins et al. | 165/181 |
| 3,746,086 | 7/1973 | Pasternak | 165/181 |
| 3,781,959 | 1/1974 | O'Connor | 29/157.3 |
| 3,877,517 | 4/1975 | Pasternak | 165/146 |
| 3,886,639 | 6/1975 | Pasternak | 29/157.3 |
| 3,901,312 | 8/1975 | Pasternak | 165/181 |
| 3,947,941 | 4/1976 | O'Connor et al. | 29/157.3 |
| 4,102,027 | 7/1978 | Greever et al. | 29/157.3 |
| 4,203,311 | 5/1980 | O'Connor et al. | 72/254 |
| 4,298,062 | 11/1981 | Pasternak | 165/181 |
| 4,381,592 | 5/1983 | Venables, III et al. | 29/157.3 |
| 4,434,841 | 3/1984 | Jackson et al. | 165/125 |
| 4,438,808 | 3/1984 | Venables, III et al. | 165/150 |
| 4,535,838 | 8/1985 | Gray et al. | 165/134 |
| 4,542,568 | 9/1985 | Venables, III et al. | 29/157.3 |
| 4,565,244 | 1/1986 | O'Connor et al. | 165/181 |
| 4,581,800 | 4/1986 | Johnson | 29/157.3 |
| 4,619,024 | 10/1986 | McManus et al. | 29/157.3 |
| 4,619,025 | 10/1986 | McManus et al. | 29/157.3 |
| 4,633,941 | 1/1987 | McManus et al. | 165/172 |
| 4,633,942 | 1/1987 | McManus et al. | 165/172 |
| 4,682,488 | 7/1987 | McManus | 72/387 |
| 4,763,726 | 8/1988 | Failing | 165/146 |
| 4,766,953 | 8/1988 | Grieb et al. | 165/177 |
| 4,770,241 | 9/1988 | McManus | 165/172 |
| 4,794,985 | 1/1989 | Paulman et al. | 165/150 |
| 4,877,087 | 10/1989 | Hill | 165/181 |
| 5,031,694 | 7/1991 | Lloyd | 165/184 |
| 5,251,692 | 10/1993 | Haussmann | 165/152 |
| 5,323,851 | 6/1994 | Abraham | 165/174 |

FOREIGN PATENT DOCUMENTS

| | | | |
|---|---|---|---|
| 0094578 | 5/1983 | European Pat. Off. | F28F 1/36 |
| 387330 | 5/1920 | Germany | 165/177 |
| 1002013 | 2/1957 | Germany | 165/177 |
| 291009 | 10/1953 | Switzerland | 165/184 |
| 445277 | 4/1936 | United Kingdom | 165/177 |
| 2085764 | 5/1982 | United Kingdom | B23P 15/26 |

*Primary Examiner*—Allen Flanigan
*Attorney, Agent, or Firm*—William J. Beres; William O'Driscoll; Peter D. Ferguson

[57] ABSTRACT

A heat exchanger for an air conditioner outdoor unit includes tubing of the microchannel type which is internally partitioned into separate, parallel refrigerant flow passages and a wrapping of heat conductive flexible heat transfer material, commonly known as spine fin. The heat exchanger provides for greater heat transfer and a more compact package. Further, such heat exchangers allow for a reduced refrigerant charge in the air conditioning unit in which they are used.

20 Claims, 5 Drawing Sheets

FIG. 4
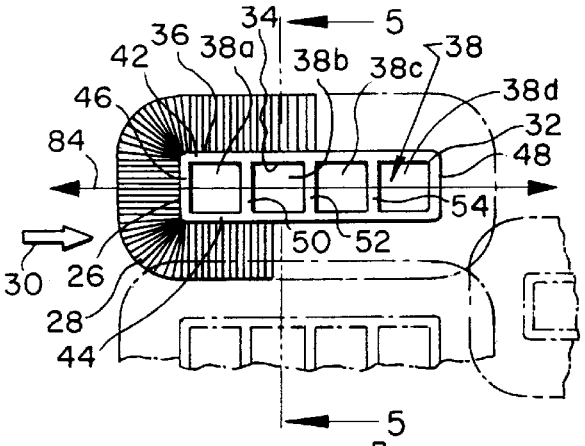
FIG. 5
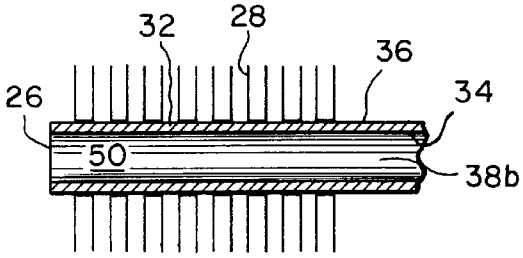
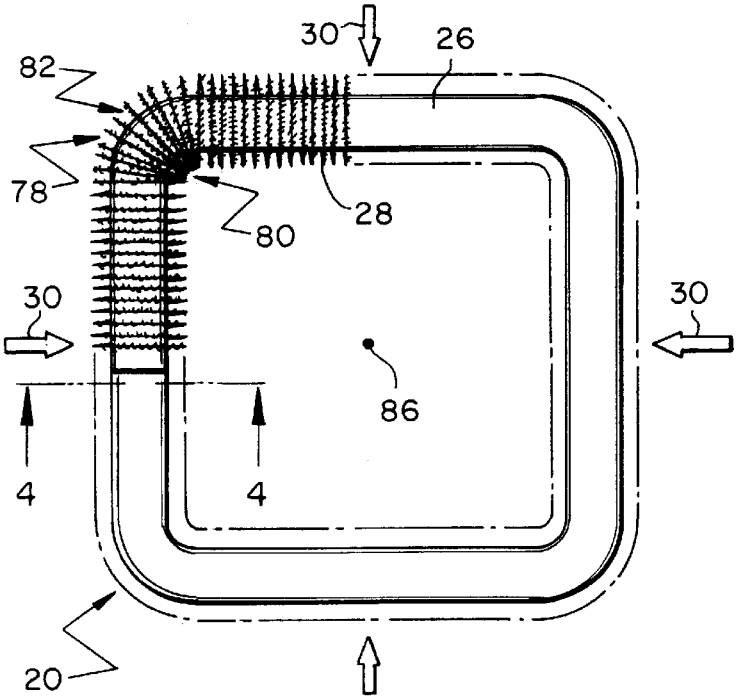
FIG. 2
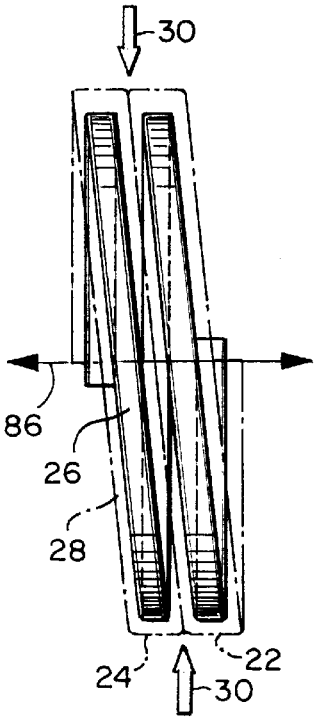
FIG 3

HEAT EXCHANGER HAVING MICROCHANNEL TUBING AND SPINE FIN HEAT TRANSFER SURFACE

BACKGROUND OF THE INVENTION

The present invention relates generally to heat exchangers. More particularly, the present invention relates to heat exchangers through which a refrigerant flows in heat exchange contact with ambient air flowing over an external surface thereof. With still more particularly, the present invention relates to a heat exchanger for an outdoor unit of an air conditioner or heat pump which employs tubing having multiple discrete flow paths for refrigerant therethrough and onto which so-called spine fin heat transfer surface is wrapped or otherwise bound.

The use of heat exchangers having a spine fin heat transfer surface in certain air conditioning applications is known as is the use of so-called microchannel tubing in certain other and different heat exchanger applications. Exemplary of the use of spine fin heat transfer surfaces in the outdoor heat exchanger coils of residential air conditioners is U.S. Pat. No. 4,535,838, assigned to the assignee of the present invention and incorporated herein by reference. It will be noted that in prior spine fin applications, tubing which is circular in cross-section and which defines a single internal refrigerant flow passage has been the norm.

Microchannel tubing is known to be used in automotive radiators. The design of such radiators calls for the brazing of fins, in a controlled fashion utilizing relatively expensive and energy consuming brazing furnaces, to the microchannel tubing or for the mechanical deformation of the tubing or its fins so as to rigidly ensconce the tubing in the fin surface with which it is used. The latter is illustrated by U.S. Pat. No. 3,603,384.

Heat exchangers have also been made using microchannel tubing in which heat transfer fins are formed by a process of gouging or otherwise forming the exterior surface of tubing itself so as to create fin-like projections. Illustrative in that regard is U.S. Pat. No. 3,886,639.

A need has been identified to minimize the operating refrigerant charges used in air conditioning units, heat pumps, and other such apparatus of the type used to cool and/or heat homes and small commercial establishments and to reduce or at least maintain the costs associated with the manufacture of such devices. This need arises from the increasing expense of raw materials used in the manufacture of heat exchangers for use in such applications, from increased prices for existing refrigerants, from the introduction of newer, higher pressure refrigerants and from a demand for more compact and less obtrusive outdoor units where the space in which to dispose such units may be at a premium. Existing outdoor heat exchanger coils for such applications are not sufficiently strong, economical of manufacture or efficient from a heat exchange standpoint to meet all of such demands.

BRIEF SUMMARY OF THE INVENTION

It is an object of the present invention to provide a refrigerant-air heat exchanger for air conditioners and heat pumps of the residential type which is more compact than the existing refrigerant-air heat exchangers used in such applications.

It is a further object of the present invention to provide a refrigerant-air heat exchanger which permits the refrigerant charge of an air conditioner in which it is used to be reduced.

It is a still further object of the invention to maintain the benefits and knowledge base, both with respect to heat transfer and economies of manufacture, associated with the use of spine fin external heat transfer surfaces on outdoor heat exchanger coils used in residential air conditioning systems yet to increase the overall heat exchange efficiency of such coils while making them more compact and stronger so as to accommodate the use of higher pressure refrigerants.

These and other objects of the present invention, which will be better understood by reference to the following Description of the Preferred Embodiment and attached Drawing Figures, are accomplished in a refrigerant-air heat exchanger coil in which a spine fin heat exchanger surface is wound onto or otherwise bound to coil tubing which has multiple discrete refrigerant flow paths. The overall cross-sectional area for refrigerant flow within the tubing is comparatively reduced while the heat transfer surface area with which refrigerant directly interacts internal of the tubing is increased. Use of such tubing increases the heat exchange efficiency of the coil, increases the strength of the coil so as to permit it to withstand higher refrigerant pressures and permits the reduction coil size and/or a reduction in the size of the refrigerant charge used in a given air conditioning unit, all while maintaining the manufacturing, heat exchange and cost benefits of using an exterior spine fin surface in such applications.

BRIEF DESCRIPTION OF THE SEVERAL VIEWS OF THE DRAWING

FIG. 2 is a schematic top view of a multi-circuited heat exchanger coil of FIG. 1.

FIG. 3 is a fragmentary side elevation of the coil of FIG. 2.

FIG. 4 is an enlarged cutaway view taken from lines 4—4 of FIG. 2.

FIG. 5 is a further enlarged cross-section taken along section lines 5—5 of FIG. 4.

DETAILED DESCRIPTION OF THE INVENTION

Figure 1:
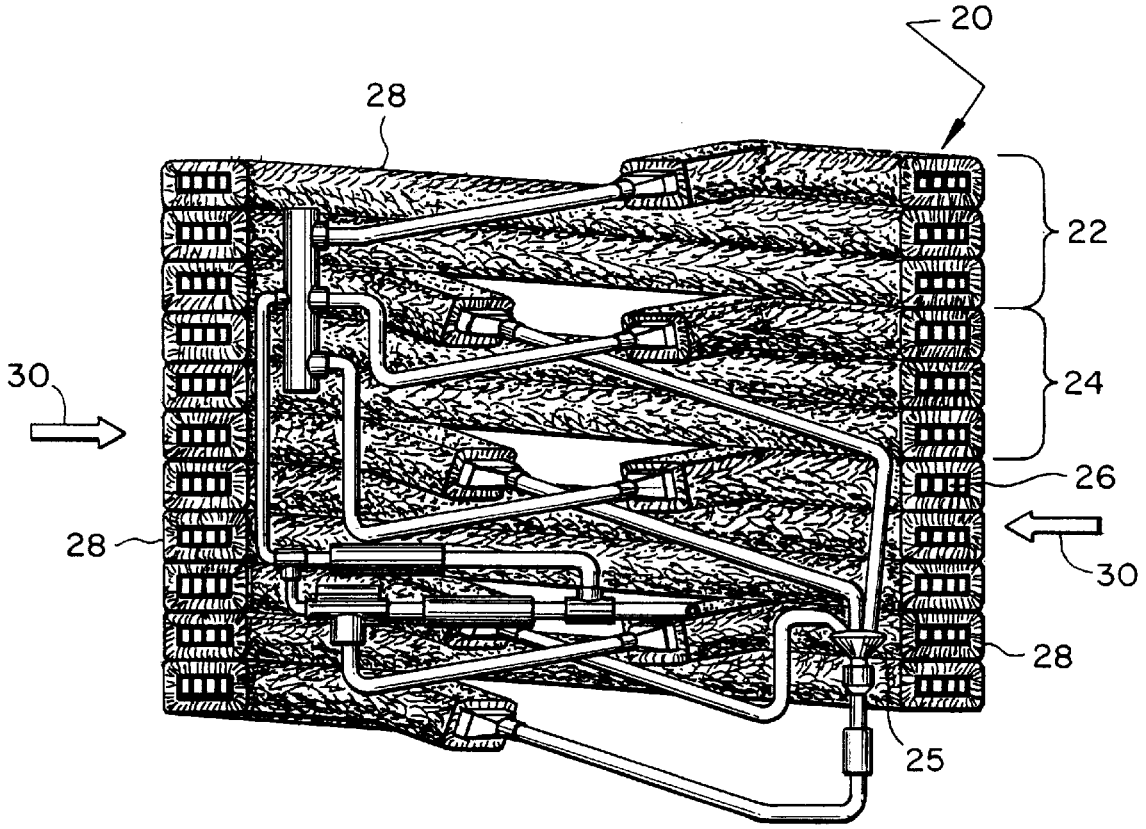
FIG. 1 is a cross-sectional view of the heat exchanger coil according to the present invention.

FIGS. 1, 2 and 3 show a helically wound heat exchanger in the form of a coil 20 wound in layered turns such as 22 and 24. Tubing 26 used in coil 20 of the present invention is of the so-called microchannel type and is itself wrapped helically with spine fin material 28, preferably over substantially its entire exterior surface, as will more thoroughly be described. Typically, vertically adjacent ones or multiple ones of such turns form independent circuits to which refrigerant is distributed for heat transfer, such as from manifold 25, with each individual circuit being formed subsequent to the winding of the heat exchanger coil as a whole. See assignee's U.S. Pat. No. 4,535,838, which is incorporated herein by reference, in that regard.

Heat exchange coil 20 is designed for and most suitable for use in the outdoor unit of a residential or so-called light commercial air conditioner or heat pump. In most such units, outdoor air enters coil 20 peripherally, as is shown by arrows 30 in FIGS. 2 through 4. A fan (not shown) mounted within or above the coil 20 causes air flow by drawing air inwardly through the coil. The fan discharges the air upwardly and away from the coil after its passage therethrough.

FIG. 4 illustrates in more detail the microchannel tubing 26 about which the spine fin material 28 is wrapped to form coil 20. Tubing 26 has an exterior wall 32 and is fabricated from a heat conductive material, most commonly aluminum or copper, although non-metallic materials may likewise be used. Wall 32 has an internal surface 34 and an external surface 36. Internal surface 34 defines an enclosed flow passage 38 extending generally along the longitudinal axis of the tubing. In this embodiment, tubing 26 is generally rectangular in cross-section.

In keeping with its rectangular cross-section, it will be appreciated from FIG. 4 that exterior wall 32 of tubing 26 is comprised of an elongated first side wall 42, an elongated second side wall 44, a shorter third side wall 46 and a shorter fourth side wall 48. Tubing 26 further includes at least one, and in this embodiment three, partition walls 50, 52, and 54 which divide enclosed refrigerant flow passage 38 into at least two, and here four, separate, parallel, four-sided refrigerant flow passages 38*a*, 38*b*, 38*c* and 38*d*. In the embodiment shown in FIG. 4, no communication is shown between the respective parallel passages. In an alternate embodiment, such communication could be provided for.

In all of the embodiments illustrated herein, microchannel tubing 26, and particularly its external surface 36, is at least substantially covered by a wrapping of heat conductive, flexible spine fin material 28. As is best illustrated in the alternative embodiment of FIG. 11, spine fin material 28 is an elongated strip generally indicated at 64 having two opposed side edges 66 and 68. Spine fin 28 is wrapped into direct heat exchange contact with the external surface 36 of tubing 26 and can be bound thereto by use of an adhesive. Otherwise, spine fin 28 can be mechanically secured to the tubing at selected points on or over generally the entirety of exterior tube surface 36. A multiplicity of integral spines 70 extend from side edge 68 of spine fin strip 64 substantially perpendicular to both the external surface 36 of tubing 28 and the adjacent face 72 of the spine fin strip.

Figure 11:
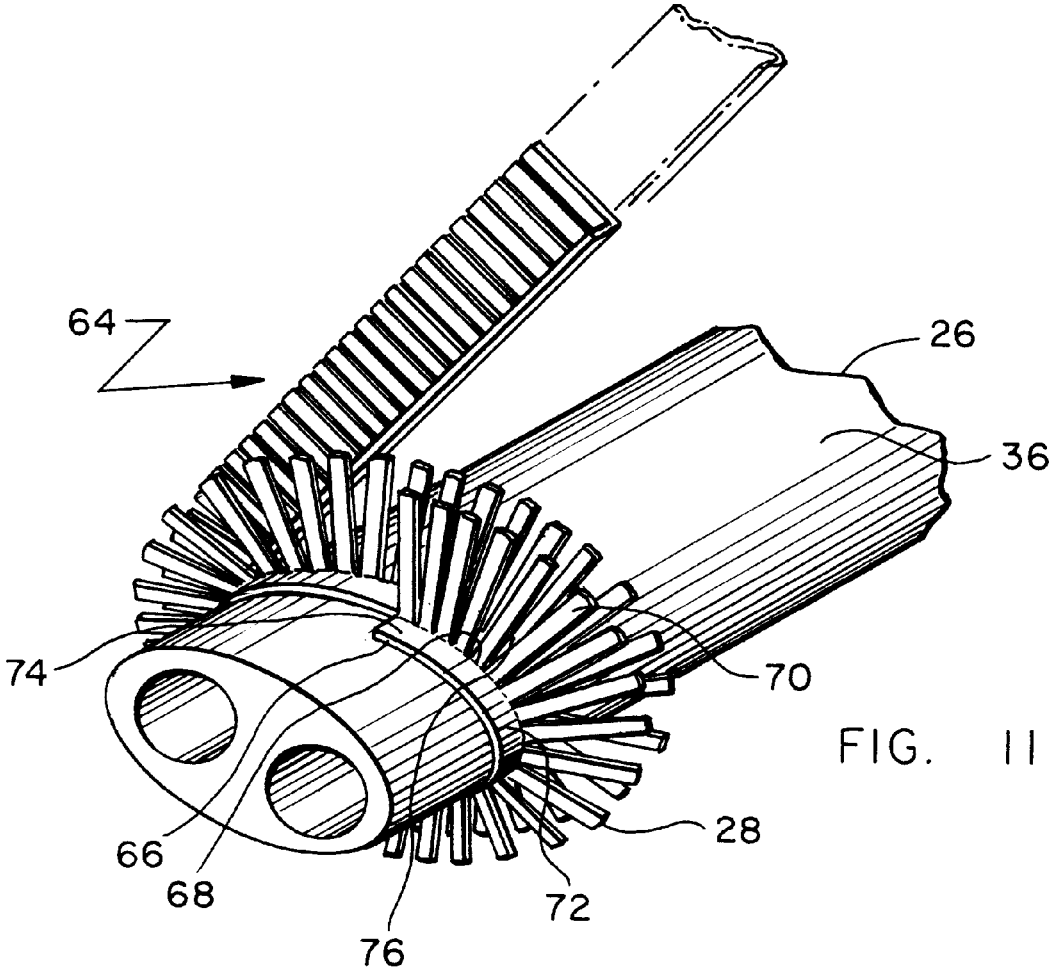
FIG. 11 is a diagrammatic perspective view of the manner in which spine fin material is wound onto a length of microchannel tubing in the course of manufacturing the heat exchanger coil of the present invention.

Still referring to FIG. 11, spine fin material 28 is known and can be fabricated, for example, from a flat, tape-like flexible strip of aluminum which is slit from one edge nearly to the other at short periodic intervals to form spines 70. Either before or after spines 70 are formed, the spine fin material 28 is folded into the generally L-shaped section so that the spines 70 project perpendicularly from face 72 of the strip 64.

Spine fin strip 64 can be applied to the tubing 26, as is shown in FIG. 11, by winding successive turns, such as 74 and 76, about external tube surface 36. This provides for intimate and efficient heat exchange contact between the spine fin strip 64 and substantially the entire external surface 36 of the microchannel tubing. In the embodiment shown in FIG. 11, successive turns 74 and 76 abut but do not overlap, thus covering substantially the entirety of surface 36 with one thickness of spine fin strip and spacing the successive rows of spines about as far apart as the separation between the side edges 66 and 68 thereof. The inventors contemplate, however, that under certain circumstances it may be desirable to overlap the turns such as 74 and 76 around at least a portion of the circumference of tubing 26. This may be done to increase the number of spines 70 provided for a given surface area location on the heat exchanger coil.

In that regard and referring to FIG. 2, a wrapping of spine fin strip may, in some instances, overlap such as in a square or rectangular heat exchanger coil which has corners 78 each of which has an inside crook 80 and an outside bend 82. Turns 74 and 76 can be overlapped along the inside crook 80 of each such corner so that complete coverage of the exterior surface of the tubing 26 at its outside bends can be provided.

Referring now to all of FIGS. 2 through 5, parallel refrigerant passages 38*a*, 38*b*, 38*c* and 38*d* have longitudinally extending centers that cooperatively define a plane 84 parallel to the longer sides 42 and 44 of the tubing. Coil 20, in this embodiment, has a winding axis 86 such that longer side walls 42 and 44 of tubing 26 are substantially parallel to the direction of air flowing across the tubing and through the coil. As a result, extended contact time and increased opportunity for heat transfer is made possible as between refrigerant flowing through passages 38*a*, 38*b*, 38*c* and 38*d* and the air flowing across the longer sides of the tubing.

As is illustrated in phantom in FIG. 4, it is also to be noted that the successive turns of the coil 20 may be spaced closely enough together such that the spines of the successive turns mesh or overlap to some degree and/or that a second, preferably vertically offset, coil portion can be formed behind a first, in the direction of airflow 30. By doing so, heat exchange is enhanced and/or the overall size of the heat exchanger coil can be reduced.

It is to be appreciated that if partition walls 50, 52 and 54 internal of tubing 26 did not exist, the overall cross-sectional flow area of the corresponding single internal flow passage 38, as defined by the interior surface 34 of tube wall 32, would be slightly increased. However, in that instance, the surface area internal of the tubing with which refrigerant flowing through passage 38 would pass in direct heat exchange contact with would be significantly reduced.

Since the efficiency of the heat transfer process is directly proportional to the internal surface area of tubing 26 refrigerant is able to come into direct contact with, the addition of partition walls 50, 52 and 54 interior of tubing 26 increases the efficiency of the heat transfer that occurs across tube wall 32. As a result, the amount of tubing needed to obtain sufficient heat transfer for a particular air conditioning application can be reduced as can be the size of the heat exchanger coil itself. Since the size of the heat exchanger coil is determinative of the size of the outdoor cabinet in which it is housed as well as the size of the refrigerant charge used in the system, the overall size of an air conditioning outdoor unit and the refrigerant charge it uses can likewise be reduced with significant savings both in material costs and system fabrication being achieved.

Figure 6:
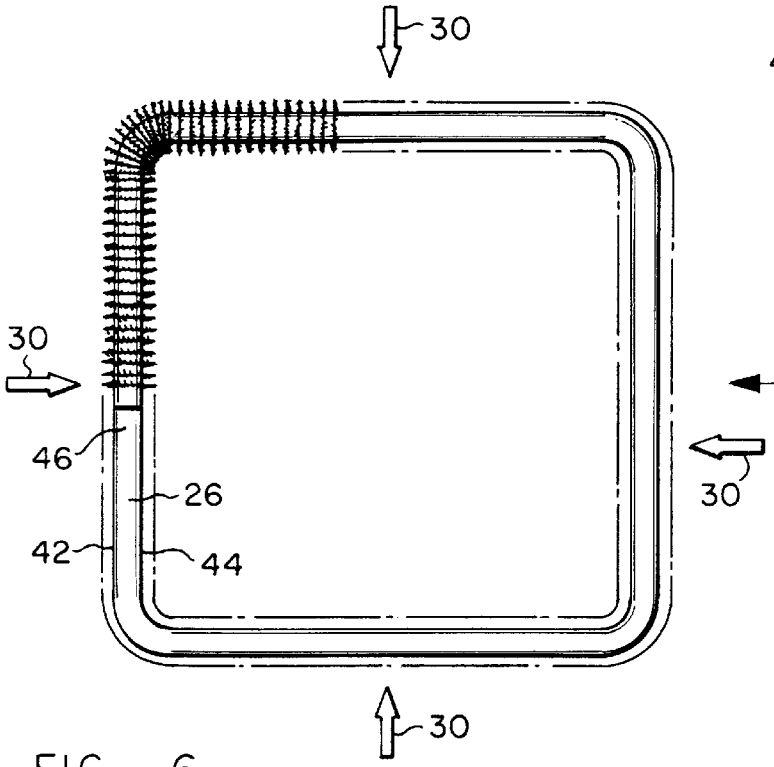
FIGS. 6 and 7 are views, similar to FIGS. 2 and 3, of a second embodiment of the present invention, in which the same type of microchannel tubing with spine fins is wound along a different axis to present a shorter flow path of air across the coil.
Figure 7:
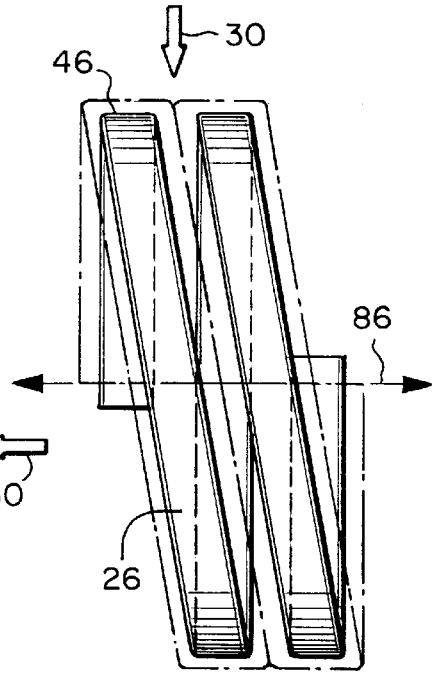

Bearing in mind the cross-sectional characteristics of the tubing 26 illustrated in FIG. 4, FIGS. 6 and 7 show a second embodiment of the present invention in which tubing 26 is wound such that the longer transverse plane 84 of tubing 26 faces into or is perpendicular to the direction of air flow 30 through the coil. In other words, air flow parallels the shorter sides 46 and 48 of the tubing 26. This orientation may provide sufficient heat transfer for a given application or unit size with the use of a lesser amount of tubing 26 yet provide for the use of the same outdoor coil enclosure or cabinet as would be used with a higher capacity air conditioning system requiring a closer packed coil and/or more coil material. Economies of manufacture across a product line can thus be achieved.

Figure 8:
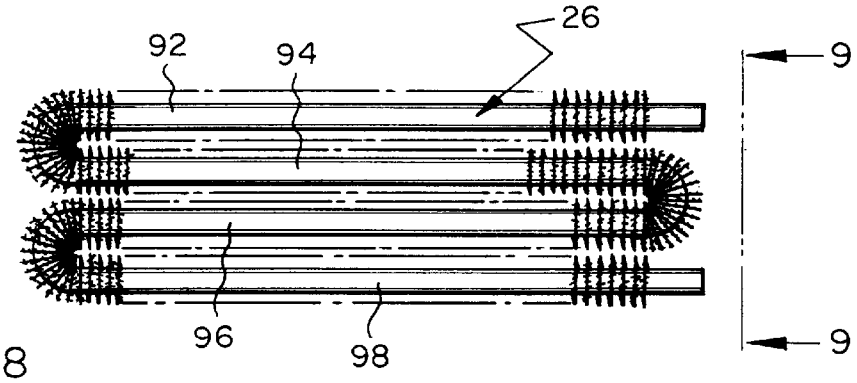
FIG. 8 is a front elevation of a third embodiment of the present invention, in which the same type of tubing is bent in serpentine fashion to form a generally planar element.
Figure 9:
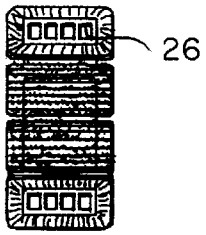
FIG. 9 is a view taken along line 9—9 of FIG. 8.

A third embodiment of the present invention is shown in FIGS. 8 and 9. In this embodiment, the tubing 26 is bent back and forth in a serpentine manner to form a series of closely spaced, substantially parallel runs such as 92, 94, 96, and 98. Runs 92–98 lie in a substantially planar array.

Referring finally and once again now to FIGS. 10 and 11, a possibly even more advantageous configuration of the present invention is illustrated. In this embodiment, microchannel tubing 26 is elliptical in cross-section and defines first and second refrigerant passages 38*a* and 38*b* (of which there could be more). Like the microchannel tubing of the previous embodiments, the tubing illustrated in FIG. 10 advantageously increases the ratio of inner tube surface area to outer tube surface area. However, by the use of an elliptical exterior shape and internal passages of circular cross-section, several advantages are gained over the earlier described embodiments.

First, the elliptical exterior shape of tubing 26 presents a surface of constant curvature around which spine fin material 28 can be wrapped. In previous embodiments, spine fin strip 64, which is relatively delicate, is wrapped around a tube geometry which includes relatively sharp corners that can cause the spine fin strip to break in the wrapping process. Such breakage can, in turn, disrupt the coil manufacturing process which must be a high speed, highly automated operation in order to achieve the economical production of such coils. The embodiment of FIG. 10 thus contemplates the advantages of existing spine fin coils relative to the wrapping of spine fin material about a continuously curved tube surface. That advantage is lost when a tube geometry is chosen such that the exterior surface to be wrapped is not essentially a smoothly transitioning curve.

Second, by the use of tubing having an overall elliptical cross-section, a more airfoil-shaped surface is presented to air flow 30. This provides advantages in terms of pressure drop in the flow of air as it passes through the heat exchanger coil in heat exchange contact therewith. By reducing or minimizing such pressure drop, the heat exchanger coil is made more efficient from an overall heat transfer standpoint.

Third, it is contemplated that the heat exchanger coils of the present invention will be employed in the future when prospectively higher pressure refrigerants come to be used in air conditioning systems. The use of higher pressure refrigerants, of course, increases the possibility of bursting a tube through an overpressure condition or through a defect in a tube wall. Also, the use of microchannel tubing having the square or rectangular cross-sections with higher pressure refrigerants will cause such non-circular refrigerant flow passages to seek circularity by the operation of the refrigerant pressure against their inner surfaces, thereby stressing the heat exchanger coil. Essentially, refrigerant passages of circular cross-section provide the "ideal" pressure vessel in which to contain pressurized refrigerant, particularly as such pressures increase, whereas refrigerant passages of non-circular cross-section, through their exposure to such elevated pressures, will seek to become circular. This particular stress on coil tubing is therefore avoided through the use of flow passages of circular cross-section.

Figure 10:
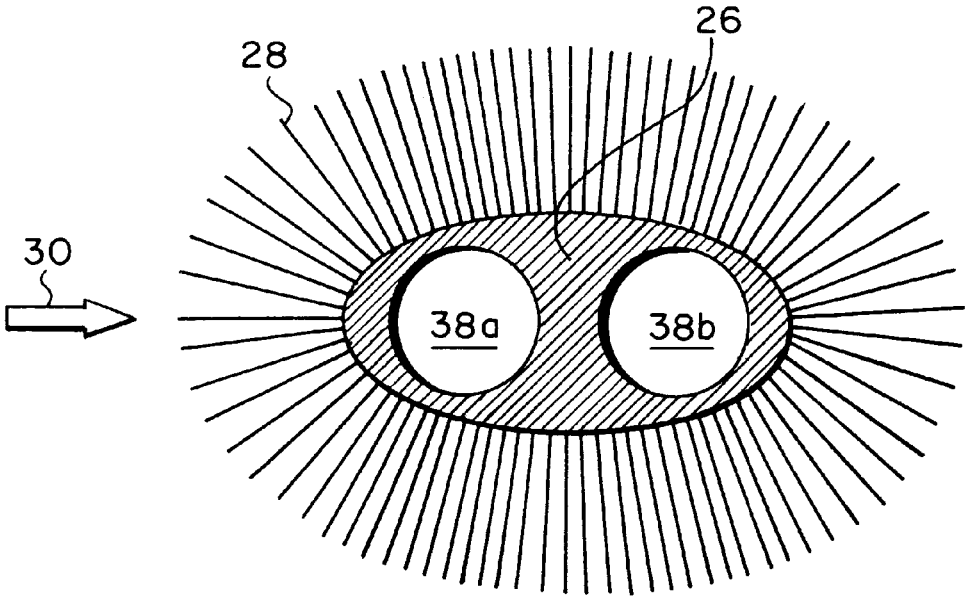
FIG. 10 is a sectional view, similar to FIG. 4, of oval-section microchannel tubing wrapped with spine fins.
Figure 12:
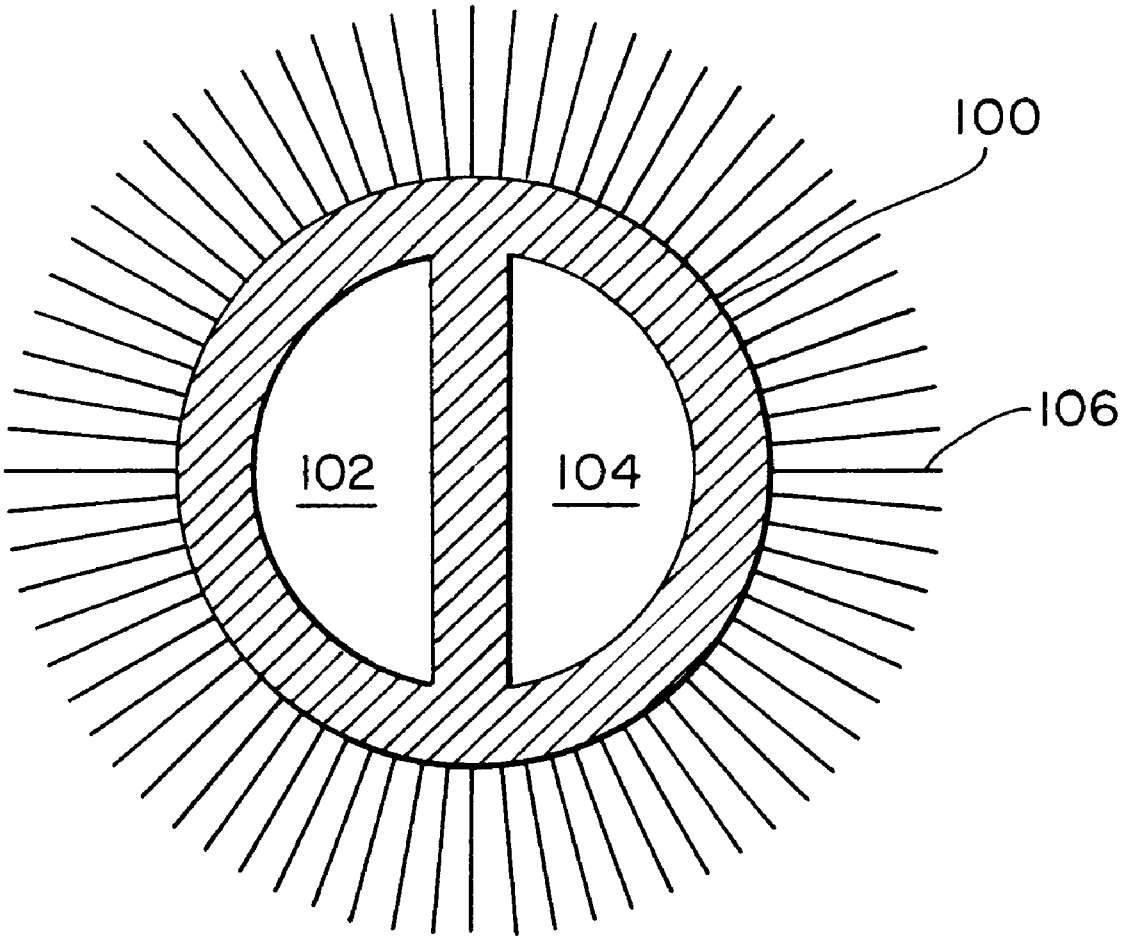
FIG. 12 is a sectional view, similar to FIGS. 10 and 4, of circular section microchannel tubing having separate generally semicircular passages and wrapped with spine fin material.

Referring finally now to FIG. 12, an additional embodiment of the present invention similar to those to FIGS. 4 and 10 is illustrated. The embodiment of FIG. 12 illustrates microchannel tubing 100 which is of circular cross-section and which defines at least two separate passages 102 and 104 which are generally semicircular in cross-section. Tubing 100 is, like the other embodiments of the present invention wrapped with spine fin material 106.

While the present invention has been described in connection with one or more preferred embodiments, it will be understood that the invention is not limited to those embodiments. Rather, the invention includes all alternatives, modifications, and equivalents as may be included within the spirit and scope of the claims which follow.

What is claimed is:

1. A heat exchanger coil for an air conditioning system comprising:

microchannel tubing having a generally flat profile, said microchannel tubing defining at least a first and a second flow passage internal of which refrigerant flows, said tubing being wound around an axis such that portions of said tubing are vertically adjacent in said coil; and a fin surface, said fin surface being of the spine fin type, said spine fin surface being a distinct fin surface element wound onto and covering substantially all of the exterior surface of said wound tubing.

2. The heat exchanger coil according to claim 1 wherein said tubing has a longer dimension and a shorter dimension in cross-section, the longer dimension of said tubing being parallel to the direction of airflow into said coil.

3. The heat exchanger coil according to claim 2 wherein the exterior shape of said tubing in cross-section is a continuous curve.

4. The heat exchanger coil according to claim 3 wherein the cross-section of said tubing is generally shaped as an airfoil.

5. The heat exchanger coil according to claim 3 wherein said first and second refrigerant flow passages are circular in cross-section.

6. The heat exchanger coil according to claim 1 wherein said tubing has four sides.

7. The heat exchanger coil according to claim 6 wherein said tubing is rectangular in cross-section and wherein said first and said second flow passages are four-sided passages, the longer said of said rectangular tubing being parallel to the direction of airflow into said coil.

8. The heat exchanger coil according to claim 1 wherein said first and said second flow passages are circular in cross-section.

9. The heat exchanger coil according to claim 8 wherein the exterior shape of said tubing in cross-section is a continuous curve.

10. The heat exchanger coil according to claim 9 wherein the cross-section of said tubing has a longer dimension and a shorter dimension and wherein the longer dimension of said tubing is parallel to the direction of airflow into said coil.

11. A heat exchange element for use in the outdoor unit of an air conditioner comprising:

a tubular wall having a generally flat profile made of heat-conductive material and having an internal surface and an external surface, said internal surface defining an enclosed space extending generally along an axis, said tubular wall being wound around a second axis so that portions of said tubular wall are vertically adjacent and form a wound coil;

at least one partition wall made of the same heat-conductive material of which said tubular wall is made, said wall being disposed in said enclosed space and dividing said enclosed space into at least two separate passages extending generally along said axis of said enclosed space; and a wrapping of heat-conductive, flexible material contacting said external surface, said wrapping having integral spines projecting outward therefrom and covering substantially all of said exterior surface of said tubular wall.

12. The heat exchange element of claim 11 wherein said at least one partition wall is formed integrally with said tubular wall.

13. The heat exchange element of claim 12 wherein the exterior surface of said tubular wall is a continuous curve in cross-section.

14. The heat exchange element of claim 13 wherein said tubular wall has a generally oval cross-section.

15. The heat exchange element of claim 14 wherein said at least two separate passages are circular in cross-section.

16. The heat exchange element according to claim 12 wherein said tubular wall has a circular cross-section.

17. The heat exchange element according to claim 16 wherein said at least two separate passages are circular in cross-section.

18. The heat exchange element according to claim 16 wherein said at least two separate passages are generally semi-circular in cross-section.

19. The heat exchange element according to claim 12 wherein said tubular wall has a generally rectangular cross-section.

20. The heat exchange element according to claim 19 wherein said at least two separate passages are four-sided passages.

* * * * *